United States Patent [19]

Beatty et al.

[11] 4,335,656

[45] Jun. 22, 1982

[54] UNDERWATER LAUNCHED PARACHUTE FLARE

[75] Inventors: Bobby D. Beatty, Bloomfield; Russell D. Daniel, Bloomington; Billy J. Humerickhouse, Odon; Richard Williams, Loogootee, all of Ind.

[73] Assignee: The United States of America as represented by the Secretary of the Navy, Washington, D.C.

[21] Appl. No.: 174,041

[22] Filed: Jul. 31, 1980

[51] Int. Cl.[3] ..... F42B 4/28

[52] U.S. Cl. ..... 102/340; 102/341; 102/351

[58] Field of Search ..... 102/341, 340, 342, 351, 102/513

[56] References Cited

U.S. PATENT DOCUMENTS

| | | | |
|---|---|---|---|
| 2,966,849 | 1/1961 | Joiner | 102/7 |
| 3,196,789 | 7/1965 | Fasig et al. | 102/7 |
| 3,199,453 | 8/1965 | Fasig et al. | 102/7 |
| 3,262,387 | 7/1966 | Reams | 102/16 |
| 3,440,960 | 4/1969 | Reams | 102/16 |
| 3,722,407 | 3/1973 | Fogal et al. | 102/16 |
| 3,782,282 | 1/1974 | Bjork | 102/16 |
| 3,875,863 | 4/1975 | Bymoen et al. | 102/19.2 |
| 3,891,162 | 6/1975 | Wolterman | 244/3.25 |
| 3,960,087 | 6/1976 | Beatty et al. | 102/341 X |
| 4,092,927 | 6/1978 | Rayle | 102/229 |
| 4,164,186 | 8/1979 | Beatty et al. | 102/37.8 |

*Primary Examiner*—Peter A. Nelson

[57] ABSTRACT

A signaling device to be launched underwater having a fuze body, a time delay element, an ejection charge and at least one carrier having a pyrotechnic composition attached to a parachute. The ejection charge is ignited by an electric squib which is detonated by voltage from a sea water battery. The battery is sealed from sea water until a valve opens to permit entry of water into the fuze body. An electronic deplay module is electrically connected between the sea water battery and squib to delay detonation of the ejection charge until the signaling device has assumed a stable vertical position at the water surface.

3 Claims, 9 Drawing Figures

OPEN CIRCUIT WITH SQUIB WIRES SHORTED OUT

CLOSED CIRCUIT WITH SQUIB WIRES NOT SHORTED OUT

UNDERWATER LAUNCHED PARACHUTE FLARE

BACKGROUND OF THE INVENTION

The present invention relates to a submarine signaling device and more particularly to a signaling device, containing one or more parachute flares, which is launched from a submerged submarine.

Pyrotechnic signals are used to indicate the presence of a submerged submarine to a surface ship. A smoke device provides a better signal during daytime and a flare provides a better signal at night. In order to eliminate the need for having two types of signals, frequently a signaling device is made that contains both a smoke charge and a flare charge.

In one type of signaling device, the signal rises to the surface and floats while burning. The range of visibility for such surface flares is about 2 or 3 miles. One such surface floating signal is described in U.S. Pat. No. 4,164,186, entitled, "Submarine Signal Fuze", which issued Aug. 14, 1979, to Bobby D. Beatty, Russel D. Daniel and Billy J. Humerickhouse. This device is comprised of a fuze body and a tube that contains both a smoke composition and a flare composition. A transfer composition is placed between the smoke composition and the flare composition to facilitate the ignition of the flare composition after the smoke composition has been burned. The smoke composition is ignited by an electrical squib which is detonated by voltage from a sea water battery which is sealed from sea water until a valve opens to permit entry of water into the fuze. An open circuit is provided between the battery and leads of the squib and, in addition, the squib leads are shorted. The opening of a valve to permit entry of sea water into a fuze causes the short to be removed and closes the circuit between the battery and the squib.

In another type of signaling device, the signal rises to the surface and then a propellant charge is ignited to launch a parachute flare. The range of visibility for such signals is materially increased over surface type signals and such aerial signal can be seen up to 5 miles. One such aerial flare is described in U.S. Pat. No. 2,966,849, which issued Jan. 3, 1961, to Harold R. Joiner and is entitled, "Submarine Signaling Device". In this device, a bellows is provided to initiate firing pin action to detonate a percussion cap which ignites a delay charge which, in turn, ignites a pyrotechnic composition.

SUMMARY OF THE INVENTION

The present invention relates to a parachute-supported signaling device which is launched underwater and consists of a cylindrical tube with a fuze assembly crimped to the base end and an ogival nose crimped to the forward end. The fuze assembly consists of a redundant ignition system with a hydrostatic valve, trip lever assembly, two sea water batteries and a fuze head assembly consisting of two squibs, two squib shorting circuits and two circuit breakers with an electronic delay system. The main body of the signal contains one or more parachute-supported pyrotechnic compositions, such as colored smoke and flare compositions.

It is, therefore, a general object of the present invention to provide an aerial signal which is launched from a submarine to rise to the water surface and is then projected into the air after the signal has assumed a stable vertical position at the water surface.

Another object of the present invention is to provide an electronic circuit between a sea water battery and an electrical squib which delays detonation of the squib until a signaling device assumes a stable position.

Other objects and advantages of the present invention will be readily appreciated as the same becomes better understood by reference to the following detailed description when considered in connection with the accompanying drawings.

DESCRIPTION OF THE PREFERRED EMBODIMENT

Figure 1:
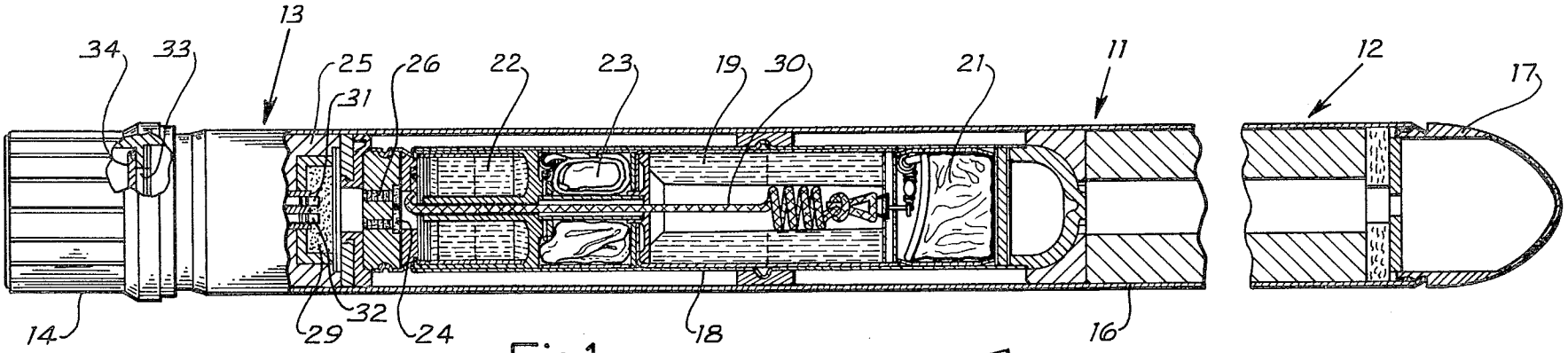
FIG. 1 is a longitudinal view, partly in section, of a preferred embodiment of the present invention.
Figure 3:
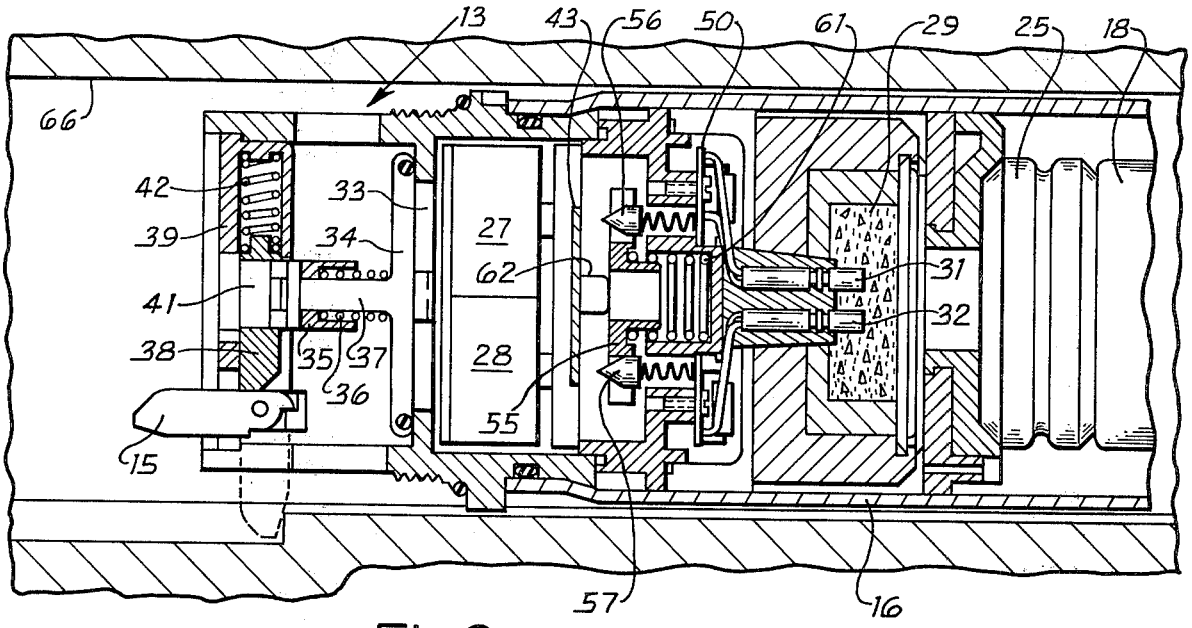
FIG. 3 is a partial view showing the aft end of the present invention in a launcher.
Figure 4:
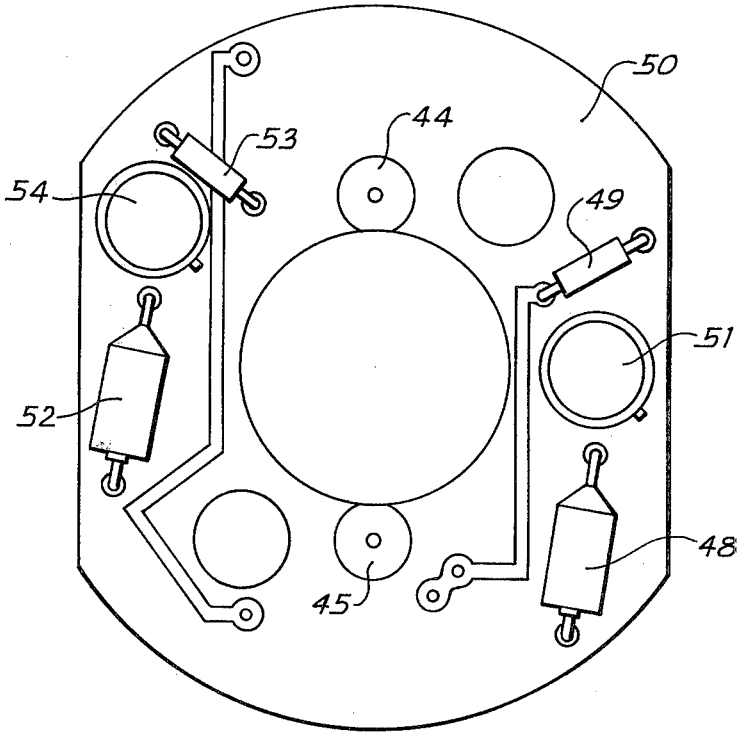
FIG. 4 is a plan view of a printed circuit board having delay circuits thereon.

Referring now to the drawings and particularly to FIGS. 1 and 3, there is shown a signaling device 11 consisting of a projectile 12 and a fuze body 13. Projectile 12 is attached to fuze body 13 by crimping and a plastic cover 14 is threadedly attached to fuze body 13 to lock a trip lever 15 and provide protection for fuze body 13. Cover 14 must be removed prior to launching signal device 11. Projectile 12 is comprised of an outer tube 16 which has its forward end closed by nose 17 and an upper carrier 18 is supported within tube 16. Upper carrier 18 contains a cannister of smoke composition 19 which is attached to a parachute 21 and also a cannister of flare composition 22 which is attached to a parachute 23. By way of example, the smoke and flare compositions might be of the formulas which are described in the above-mentioned U.S. Pat. No. 4,164,186. An upper carrier ejection charge 24 is provided in base plate 25 which closes the aft end of upper carrier 18, and ejection charge 24 is ignited from a delay charge 26 which permits upper carrier 18 to reach a desired altitude before parachutes 21 and 23 are deployed.

Referring now particularly to FIG. 3 of the drawings, two sea water batteries 27 and 28 are positioned within fuze body 13 and are connected through delay circuitry to separate electric squibs 31 and 32 which are positioned to detonate projectile ejection charge 29. An opening 33 is provided in fuze body 13 and valve 34 is provided to close opening 33 and prevent sea water from energizing batteries 27 and 28. A collar 35 and spring 36 are provided around a stem 37 on valve 34 and a slider 38, which is slidably mounted in a housing 39, retains collar 35 and spring 36 in a locked position whereby spring 36 is compressed and provides a force for keeping valve 34 tightly closed. Slider 38 has a clearance hole 41 for releasing collar 35 and a spring 42 is positioned in housing 39 for moving slider 38.

Figure 5:
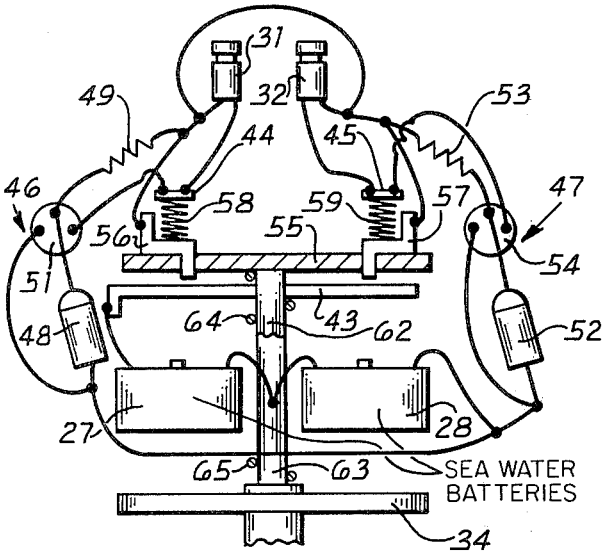
FIG. 5 is a circuit diagram showing an opened circuit and a shorted condition for a battery, squib and delay circuit.
Figure 6:
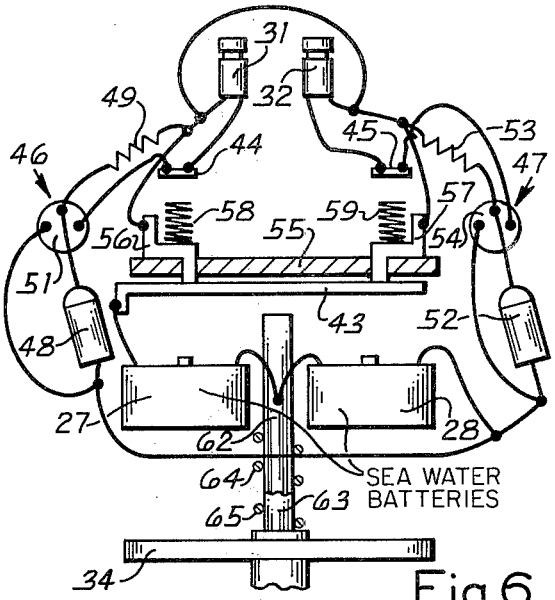
FIG. 6 is a circuit diagram showing a closed condition for a battery, squib and delay circuit.

Referring now to FIGS. 4, 5, 6, and 9 of the drawings, batteries 27 and 28 are connected in series, and the positive terminal of battery 27 is electrically connected to stationary contact plate 43. A pair of stationary contacts 44 and 45 are electrically connected, respectively, to squibs 31 and 32 and the negative terminal of battery 28 is electrically connected to squibs 31 and 32 through separate delay circuits 46 and 47 which are mounted on a printed circuit board 50. Delay circuit 46 is comprised of a reversible electronic integrator 48, resistor 49 and control rectifier 51 and, likewise, delay circuit 47 is comprised of a reversible electronic integrator 52, resistor 53 and control rectifier 54. A movable circuit breaker plate 55 is positioned between stationary contact 43 and contacts 44 and 45. Breaker plate 55 has two contacts 56 and 57 thereon, and contact 56 is electrically connected to squib 31 and contact 57 is electrically connected to squib 32. As best shown in FIG. 5 of the drawings, a metallic spring 58 is positioned between contacts 44 and 56 and thus shorts the leads of squib 31 and, likewise, a spring 59 is positioned between contacts 45 and 57 and shorts the leads of squib 32. As shown in FIG. 6, however, when circuit breaker plate 55 moves so that contacts 56 and 57 engage plate 43, springs 58 and 59 are not of sufficient length to engage both stationary contacts and the contacts on breaker plate 55 and thus springs 58 and 59 no longer short the leads of squibs 31 and 32.

A spring 61 is used for moving circuit breaker plate 55 so that contacts 56 and 57 can engage contact 43. However, until valve 34 is opened, a pair of stop pins 62 and 63, positioned between plate 55 and valve 34, prevent movement of plate 55. Springs 64 and 65 surround stop pins 62 and 63, respectively, and provide forces for opening valve 34 when signaling device 11 reaches the surface.

By way of example, reversible electronic integrators 48 and 52 might be of the type manufactured by Plessey Electro-Products, Los Angeles, California, under the tradename of E-CELL device. An E-CELL device consists of a silver case serving the triple function of an electrode, a reservoir of active metal (silver), and a container for the electrolyte. It is called the reservoir electrode. The electrolyte serves as the vehicle for ion conduction between the electrodes—the only electron transfer process that occurs. The center, or working electrode, is gold. One atom of silver is electroplated on or off of the gold working electrode for every electron entering the cell. Silver is added (integral increased) on the working gold electrode when electrons enter the gold working electrode and leave the silver case, and is removed (integral decreased) when the polarity is reversed. When the integral is zero all the silver has been removed from the gold working electrode; no furthr ion conduction can occur and the E-CELL integrator becomes an electrical open circuit (stop region).

Figure 7:
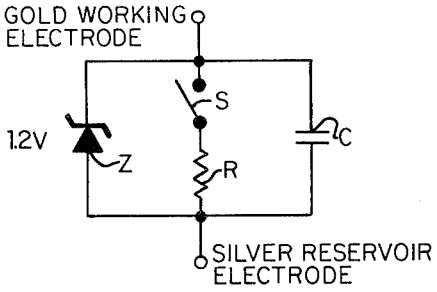
FIG. 7 is an equivalent circuit for an E-CELL device.
Figure 8:
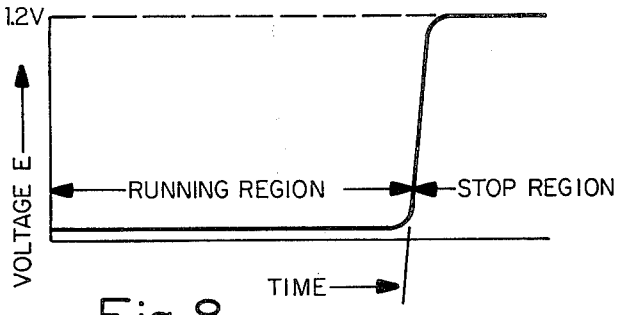
FIG. 8 is a diagram showing an operating curve for an E-CELL.

Referring now to FIG. 7 of the drawings, there is shown an approximate equivalent electrical circuit of an E-CELL device. The switch (S) is closed for all integrals greater than zero. At zero integral, a change of electrical state occurs which is represented by the switch opening, stop (clear) condition. The electrical properties are then primarily characterized by a capacitor, C, in parallel with a 1.2 volt zener diode, Z. FIG. 8 of the drawings is a typical voltage vs. time history of an E-CELL device which has a preset integral (charge) at zero time. The voltage drop across the E-CELL device, when in the running region, is very low. Upon reaching the stop region, the voltage rises to approximately 1.2 volts.

Figure 9:
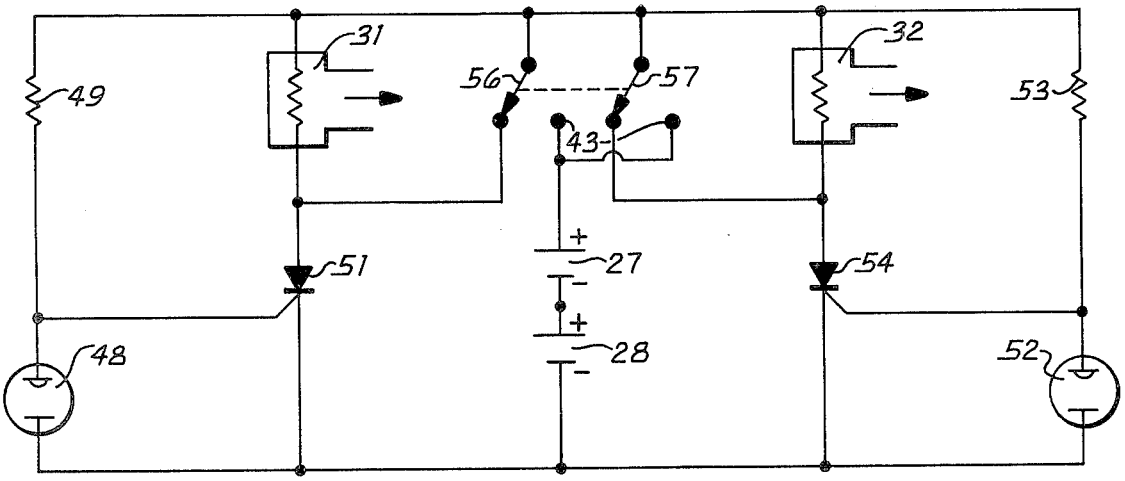
FIG. 9 is a circuit diagram for a pair of delay devices.

Referring now to FIG. 9 of the drawings, when contacts 56 and 57 are engaged with contact 43, and assuming batteries 27 and 28 are immersed in salt water, current from the batteries will deplate silver from the gold working electrodes of E-CELL devices 48 and 52 but, while in the running region as shown in FIG. 8 of the drawings, control rectifier 51 will block the firing of squib 31 and, likewise, control rectifier 54 will block the firing of squib 32. When all the silver has been deplated from the gold working electrode of E-CELL device 48, device 48 operates as an open switch and control rectifier 51 is gated on and squib 31 is detonated. Likewise, when all the silver has been deplated from the gold working electrode of E-CELL device 52, device 52 operates as an open switch and control rectifier 54 is gated on and squib 32 is detonated. By way of example, E-CELL device 48 might be set to provide a ten second delay period and E-CELL device 52 might be set to provide a twenty second delay period. This time difference assures that there is sufficient power from batteries 27 and 28 to fire squib 32, in the event that there is some malfunction which would prevent squib 31 from firing.

OPERATION

Upon launching, launcher 66 trips lever 15 thereby permitting spring 42 to move slider 38 so that hole 41 is aligned with collar 35. Spring 36 then moves collar 35 into hole 41 and all mechanical pressure is removed from valve 34. Water pressure, however, is sufficient to keep valve 34 closed and batteries 27 and 28 are not energized.

As signaling device 11 rises, the ambient sea pressure is reduced and when signaling device nears the surface, the forces applied by springs 64 and 65 which surround stop pins 62 and 63 becomes greater than the ambient sea pressure and valve 34 opens thereby flooding the battery compartment and sea water acts as an electrolyte to energize the plates of batteries 27 and 28. Movement of stop pins 62 and 63 allow spring 61 to move circuit breaker plate 55 so that springs 58 and 59 no longer short squibs 31 and 32.

Figure 2:
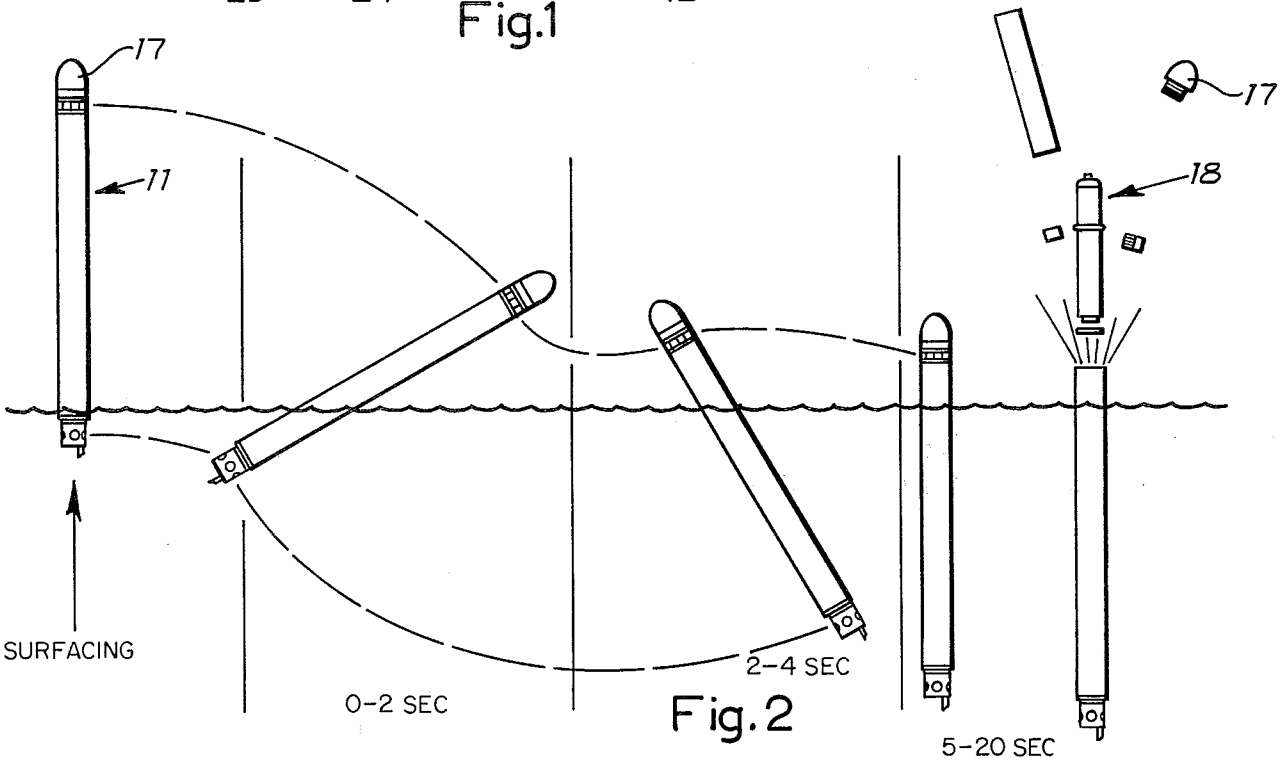
FIG. 2 is a diagrammatic view showing the motion of an underwater-launched signal upon reaching the water surface.

Referring now to FIG. 2 of the drawings, it can be seen that the momentum of signaling device 11 causes nose 17 to rise a substantial distance above the water surface and then, for a period of four or five seconds, the signaling device 11 will pitch and roll until it finally assumes a stable vertical position. it is the function of delay circuits 46 and 47 to prevent detonation of squibs 31 and 32 until signaling device 11 has assumed a stable vertical position. By way of example a delay period of about ten seconds might be set for reversible electronic integrator 48 and a period of about twenty seconds might be set for reversible electronic integrator 52. Upon entry of salt water into the battery compartment of fuze body 13, batteries 27 and 28 become energized and current will flow through both integrators 48 and 52. After about ten seconds, integrator 48 will reach the "stop region", as shown in FIG. 8 of the drawings, and control rectifier 51 will be gated on and squib 31 will be detonated. Detonation of squib 31 will, in turn, detonate ejection charge 29 and, as shown in FIG. 2 of the drawings, upper carrier 18 will be launched.

Upon launching of upper carrier 18, delay charge 26 will be ignited and, after a few seconds, during which upper carrier 18 is traveling upward to a desired height, ejection charge 24 will ignite to separate smoke composition 19, parachute 21, flare composition 22 and parachute 23 from upper carrier 18. Ignition of flare composition 22 and smoke composition 19 is made by a quick-match fuze 30 which is ignited by the ignition of ejection charge 24.

In the event that squib 31 fails to detonate, squib 32 will be detonated about twenty seconds after batteries 27 and 28 are energized. Squib 32 and delay circuit 47 are used as a back-up system and serve no further function.

Obviously many modifications and variations of the present invention are possible in the light of the above teachings. It is therefore to be understood that the invention may be practiced otherwise than as specifically described.

We claim:

1. A signaling device adapted to be launched in a body of sea water beneath the surface thereof comprising, a fuze body having an inner chamber and an aperture communicating therewith, valve means in said fuze body normally closing said aperture communicating with said inner chamber of said fuze body and preventing sea water from entering therein, a projectile shell attached to said fuze body and containing an upper carrier, said upper carrier having at least one container or pyrotechnic composition and a parachute attached to said container, an ejection charge for launching said projectile shell into the air, squib means for igniting said ejection charge, at least one sea water battery within said inner chamber of said fuze body for detonating said squib means, and an electronic delay circuit connected between said squib means and said sea water battery for delaying current to said squib means for a predetermined time after said sea water battery is energized by opening of said valve means and entry of sea water into said inner chamber of said fuze body, said electronic delay circuit including a control rectifier and a reversible electronic integrator, said control rectifier being gated on to pass current to said squib means when said reversible electronic integrator has a change of electrical state.

2. A signaling device adapted to be launched in a body of sea water beneath the surface thereof as set forth in claim 6 wherein said reversible electronic integrator is adaptable for setting in a predetermined period of time for current to flow through said reversible electronic integrator before a change of electrical state occurs.

3. A signaling device adapted to be launched in a body of sea water beneath the surface thereof comprising, a fuze body having an inner chamber and an aperture communicating therewith, valve means in said fuze body normally closing said aperture communicating with said inner chamber of said fuze body and preventing sea water from entering therein, a projectile shell attached to said fuze body and containing an upper carrier, said upper carrier having at least one container of pyrotechnic composition and a parachute attached to said container, an ejection charge for launching said projectile shell into the air, first and second squibs for igniting said ejection charge, at least one sea water battery within said inner chamber of said fuze body for detonating said first and second squibs, and a first electronic delay circuit connected between said first squib and said sea water battery for delaying current to said first squib for a first predetermined time after said sea water battery is energized by opening of said valve means and entry of sea water into said inner chamber of said fuze body, and a second electronic delay circuit connected between said second squib and said sea water battery for delaying current to said second squib for a second predetermined time different than said first predetermined time after said sea water battery is energized, said first and second electronic delay circuits each including a reversible electronic integrator and a control rectifier arranged to be gated on by said reversible electronic integrator.

* * * * *